US005220134A

United States Patent [19]

Novel et al.

[11] Patent Number: 5,220,134

[45] Date of Patent: Jun. 15, 1993

[54] COMPOSITE INSULATOR AND METHOD FOR ITS MANUFACTURE

[75] Inventors: Pierre Novel, Saint-Etienne; Roger Bastard, Saint Genest Malifaux, both of France

[73] Assignee: Societe Nouvelle des Etablissements Dervaux, Le Chambon Feugerolles, France

[21] Appl. No.: 649,767

[22] Filed: Jan. 25, 1991

[30] Foreign Application Priority Data

Jan. 26, 1990 [FR] France ..... 90 01373

[51] Int. Cl.[5] ..... H01B 17/12; H01B 17/02

[52] U.S. Cl. ..... 174/179; 174/178; 174/209; 174/176; 174/169

[58] Field of Search ..... 174/179, 74 R, 152 R, 174/267, 192, 177, 176, 169, 158 R, 137 B, 209, 178

[56] References Cited

U.S. PATENT DOCUMENTS

| | | | |
|---|---|---|---|
| 2,970,186 | 1/1961 | Von Platen | 174/179 |
| 3,109,052 | 10/1963 | Dumire et al. | 174/75 C |
| 3,134,164 | 5/1964 | Hocks | 29/155.52 |
| 3,898,372 | 8/1975 | Kalb | 174/179 |
| 4,401,841 | 8/1983 | Meyer et al. | 174/31 R |
| 4,440,975 | 4/1984 | Kaczerginski | 174/179 X |
| 4,491,687 | 1/1985 | Kaczerginski et al. | 174/178 |
| 4,654,478 | 3/1987 | Ishihara et al. | 174/176 |
| 4,724,284 | 2/1988 | Wheeler | 174/152 R |
| 4,845,318 | 7/1989 | Clabburn et al. | 174/179 X |

FOREIGN PATENT DOCUMENTS

| | | |
|---|---|---|
| 1921299 | 6/1970 | Fed. Rep. of Germany . |
| 2089141 | 4/1982 | United Kingdom . |

*Primary Examiner*—Leo P. Picard
*Assistant Examiner*—Hyung S. Sough
*Attorney, Agent, or Firm*—Oliff & Berridge

[57] ABSTRACT

An insulator of the type composed of a core onto which a skirt made of insulating material and provided with fins is molded. The core comprises an axial rod of a composite material onto whose ends the end sleeves of mounting terminals are swaged.

The rod comprises a web of longitudinal, parallel fibers bonded by thermosetting resin and encased in a braided or woven envelope like covering. A mounting terminal is connected to an end of the rod by a combination of uniformly distributed radial locking of the sleeve onto the rod and by penetration of the metal of the sleeve into gaps between the fibers of the envelope like covering.

5 Claims, 2 Drawing Sheets

COMPOSITE INSULATOR AND METHOD FOR ITS MANUFACTURE

BACKGROUND OF THE INVENTION

The invention relates to composite insulators, consisting firstly of a core formed by a longitudinal rod of composite material, to whose ends are attached the sleeves of mounting connectors made of malleable metal, and secondly of an insulating skirt of synthetic material, provided with fins and molded onto the core.

In general, the rod is composed of fibers of glass or another substance, arranged longitudinally and joined by pultrusion, i.e., by passing them between heated jaws which crosslink the thermosetting resin surrounding the fibers.

In this method, the rod has an irregular diameter, shape, and size, so that after being cut to length it is subjected to longitudinal machining intended to confer on it a circular cross section of constant and precise diameter, allowing it to be inserted in the sleeve. Experience shows that this machining affects not only the bonding resin but the fibers as well, and creates microcracks which can be the source of breakage over time.

The rod is joined to the end sleeves by various methods. The method most often employed consists in swaging each sleeve onto the rod, using jaws composed of several parts and delimiting between them a throat with a polygonal or circular cross section. When locking radially, each of the jaw elements is subjected to a radial force causing radial tightening of the sleeve which is not uniform circumferentially, regardless of the structure of the jaws, tending to make the rod oval and sometimes delaminating its constituent fibers. As a result, the core of the insulator is rejected.

Another method consists in swaging the sleeve using radial strips arranged regularly around the sleeve, mounted so that they pivot around axes perpendicular to the longitudinal axis of the sleeve. The progressive contact of their working faces on the sleeve produces a continuous compression that permits the metal to flow lengthwise ahead of them. Here again, despite the large number of areas of application of the radial swaging force of the sleeve and variation of the magnitude of this force during the swaging operation, the locking force is not really uniform and delamination is possible.

This disadvantage is combined with the difficulty of obtaining the required degree of force for radial locking of the sleeve on the rod. An adhesion bond between machined and hence nearly smooth surfaces is involved here, so that the best grip can be obtained only with maximum locking, which means swaging the rod as well. By nature, a rod made of a composite material with a matrix that is generally an epoxy, offers excellent longitudinal tensile strength, but it also has a low resistance to transverse shear. Consequently, to prevent it from breaking transversely when the sleeve is swaged onto it, the locking rate and hence the residual locking force on the rod must both be limited. Consequently, if the ends supplied are made of a metal alloy of an unstable metallurgical nature or if the sleeves are of variable thickness, the magnitude of the residual locking force can vary in such manner that it decreases, allowing the rod and the sleeve to separate for example, under the influence of torque.

SUMMARY OF THE INVENTION

The goal of the present invention is to provide a composite insulator in which the bond between the terminal and the rod is constant and stable, and exhibits excellent resistance to both twisting and longitudinal pull.

To this end, in the composite insulator of the invention, the rod is composed of a web of fibers arranged in parallel longitudinally and held together by a thermosetting resin having a peripheral envelope composed of continuous fibers locked to the web and joined thereto by the thermosetting resin. Each of the sleeves of the mounting terminals is connected to the corresponding end of the rod, firstly by radial locking of the sleeve on the rod and secondly by penetration of the metal of the sleeve into gaps between the envelope fibers. In the embodiments, the envelope is composed of a braided or woven covering.

Penetration of the metal of the sleeve into the gaps between the envelope fibers, for example, into the mesh of the braid, forms notches to provide positive anchoring between the rod and its sleeves and to create resistance to delamination, both under traction and in torsion, greater than that of known insulators, while limiting the radial swaging force to a level much less than the shear strength of the rod.

The invention likewise provides for a method of manufacturing a composite insulator of the type recited hereinabove. The method comprises making the composite rod from a web of longitudinal and parallel fibers impregnated with resin, encasing the web in an envelope of continuous fibers, cutting the resultant rod to length and beveling it, fitting each end of the rod, in the roughly manufactured state, into the metal sleeve of a mounting terminal, likewise roughly manufactured, and performing the clamping operation by affixing the sleeve onto the end of the rod using a circular die. The die, having two elements arranged on a cylindrical sleeve support, is displaced lengthwise toward the end of the sleeve to swage the sleeve onto the rod. This is done with a constant swaging rate sufficient to cause component metal of the sleeve to flow simultaneously both radially, with uniform distribution between the gaps in the peripheral envelope of the rod and without exceeding the shear strength of this rod, and longitudinally as the die is displaced along the sleeve.

As the die is displaced along the sleeve, it subjects the latter to compression by extrusion, forcing the metal making up the sleeve to flow ahead of the die. The envelope surrounding and protecting the web of the rod ensures that this flow exerts only a slight tensile stress on the fibers in the web so that there is no risk of these fibers being delaminated by the stress.

In addition, thanks to the uniform distribution of the locking force exerted on the rod by the sleeve over the entire periphery of the rod, the average force on the rod is less than that produced by the other known methods for a given tear resistance of the bond.

The process is simple and yields constant and repetitive results, especially since, with the exception of cutting the rod to length, the elements composing the core of the insulator are not subjected to any type of machining that could alter their physical characteristics.

Other characteristics and advantages will be apparent from the following description that refers to the attached figures showing, as nonlimiting examples, a plurality of embodiments of insulators obtained by the method according to the invention.

DESCRIPTION OF THE PREFERRED EMBODIMENT

Figure 1:
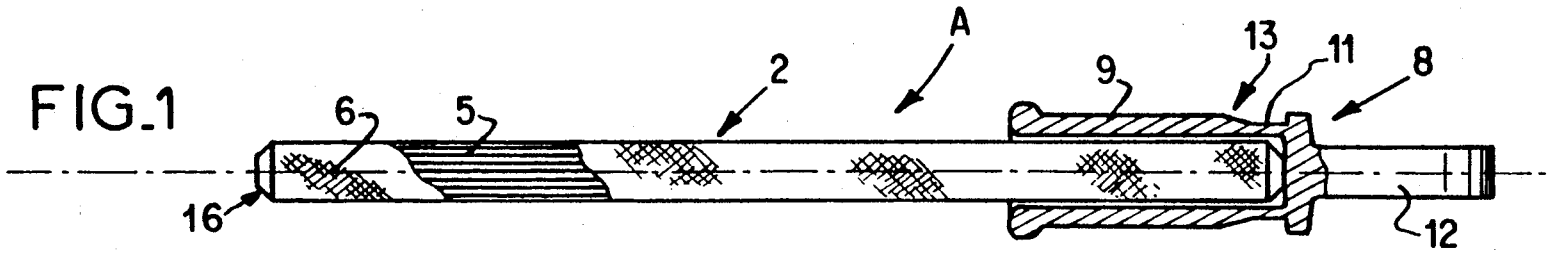
FIG. 1 is a side view in partial section showing the components of the core of an insulator.

Similar to the basic structure of known insulators, the insulator is composed of a core, generally designated A, composed of a rod 2 whose ends are integral with mounting terminals 7 and 8, and a sleeve of synthetic material 3 molded onto the core to have peripheral spaced fins 4.

However, according to the invention, rod 2 is composed of a web of fibers 5 made of glass or synthetic material, pre-impregnated with a thermosetting resin, arranged parallel to one another to form a continuous bundle that is encased in a tubular braid 6. Tubular braid 6 is made of continuous glass fibers and formed on the web. During formation of the tubular braid 6, the force communicated to the component fibers of the braid results in seepage of the resin impregnated in the longitudinal fibers of the bundle into the braid. Consequently, the resin impregnates the fibers of the braid and thus ensures that the braid will be bonded to fibers 5 after crosslinking. The excess resin can be removed by an annular seal before the rod enters a chamber where it is crosslinked. In a variation on this embodiment, the braid is replaced by a weave wrapped and locked around fibers 5.

Encasing the bundle of fibers in the tubular envelope gives rod 2 a constant diameter thus making it unnecessary to machine the rod by turning.

In known fashion, each of the mounting terminals 7 and 8 comprises a sleeve 9 integral with a mounting part which comprises a cap 10 in the case of terminal 7 and a pierced tenon 12 in the case of terminal 8. Each terminal is produced by precision molding and is made of malleable metal such as steel or an aluminum alloy.

According to the invention, the sleeve 9 of each terminal 7 and 8, after molding, comprises a throat 13 located opposite its free end. The bottom 11 of this throat has the dimensions and shape of the internal bore 14 of a two-part die 15 that will be used later to swage the sleeve over the end of the rod.

After rod 2 has been cut to length and an end bevel 16 formed, and with no other machining, on each of its ends, each end is engaged in the internal bore of the corresponding sleeve 9, the sleeve itself not being required to undergo any machining. The bond between each sleeve and the corresponding end of the rod is provided by compression and threading using die 15. The die 15 is initially positioned at throat 13 and displaced lengthwise along the sleeve moving toward the free or open end. Under the influence of this displacement, the metal composing the sleeve flows ahead of the die causing the sleeve to elongate.

Figure 2:
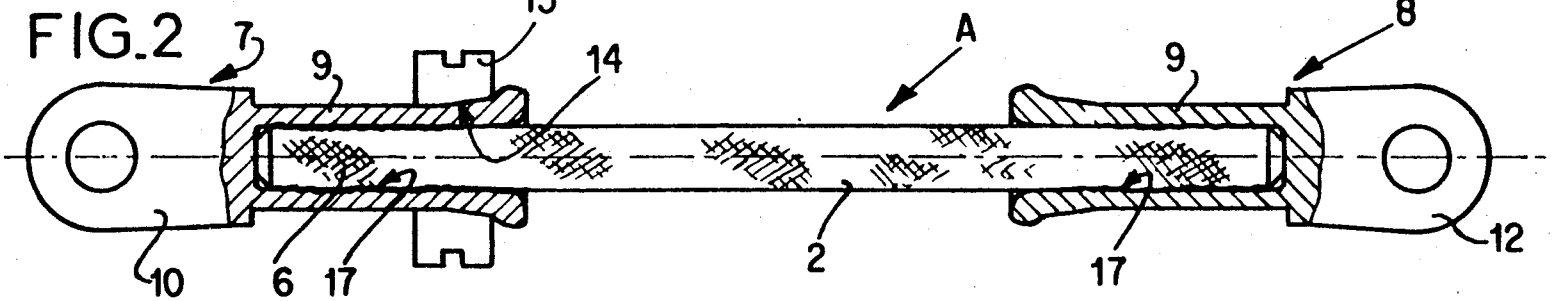
FIG. 2 is a side view of a partial section showing the core after the terminal sleeve has been swaged onto it.
Figure 3:
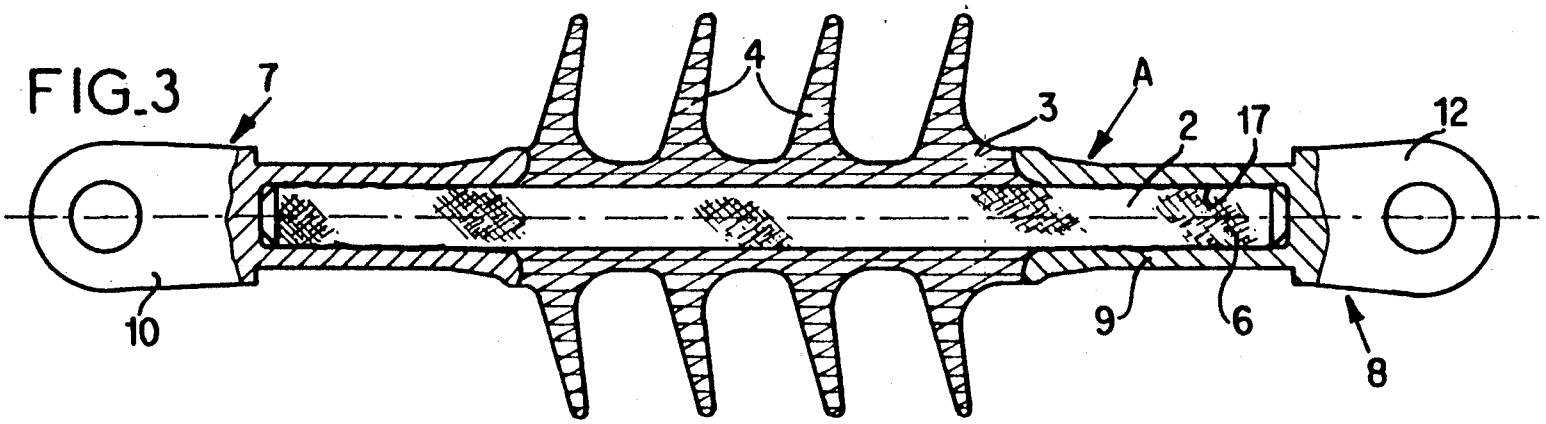
FIG. 3 is a side view in cross section showing one embodiment of the resultant insulator.

The locking force produced by the die is sufficiently great to cause the flow. It does without subjecting the rod to a force that causes swaging of the end of the rod but permits the metal forming the sleeve to enter the gaps in the mesh of braid 6 to form the notches as shown schematically at 17 in FIG. 2. These notches provide a positive mechanical link between the rod and the corresponding sleeve.

The resultant bond possesses a tensile strength similar to that produced by traditional methods and a torsional strength greater by at least 30% than that obtained by the traditional methods. However, the manufacturing process results in a core rod that is free of microcracks and delaminated fibers.

When core A has been produced in this fashion, it is inserted without any machining into a mold where skirt 3 is molded over it. The skirt is made of a synthetic material 3 with good electrical insulating characteristics, such as an elastomer, a thermoplastic material, or a thermosetting material.

Figure 4:
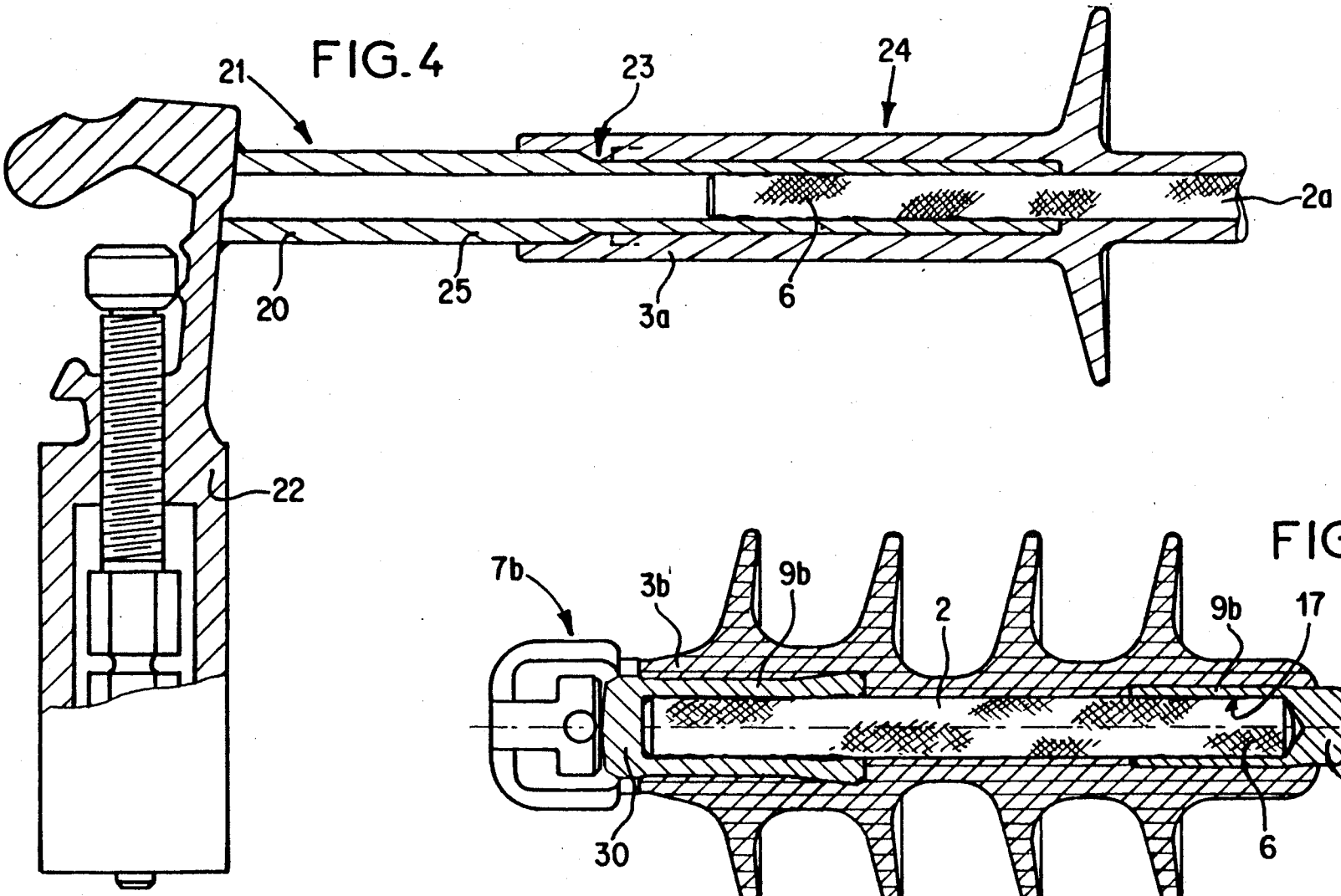
FIG. 4 is a partial side view in cross section showing one end of a phase separator produced according to the invention.

In the embodiment shown in FIG. 4, showing a phase separator, sleeve 20 of terminal 21 is integral with body 22 of a locking clip on one of the conductors of one of the phases. A longer sleeve than that of the previous embodiment, the sleeve, when molded, has a throat 23, indicated by the dashed line in FIG. 4, allowing it to be mounted by compression and stretching, using a die, on the end of a rod 2*a*.

This diagram shows that after a sleeve 20 is mounted on the rod, skirt 3*a* extends just above junction area 24 to protect the latter against any penetration of water and to provide a transition to thicker zone 25 of the sleeve, the area where an electrical power arc forming between the ends of the spacer would land.

In a variation on this spacer, the sleeves are swaged onto the rod after it has received the skirt. In this case the sleeve comprises a shoulder whose wider part can cover the corresponding end of the skirt, and the swaging operation involving compression and drawing likewise affects this larger diameter part, so that it is locked radially onto the end of the skirt. This arrangement improves the tightness of the joint between the rod and the sleeve.

Figure 5:
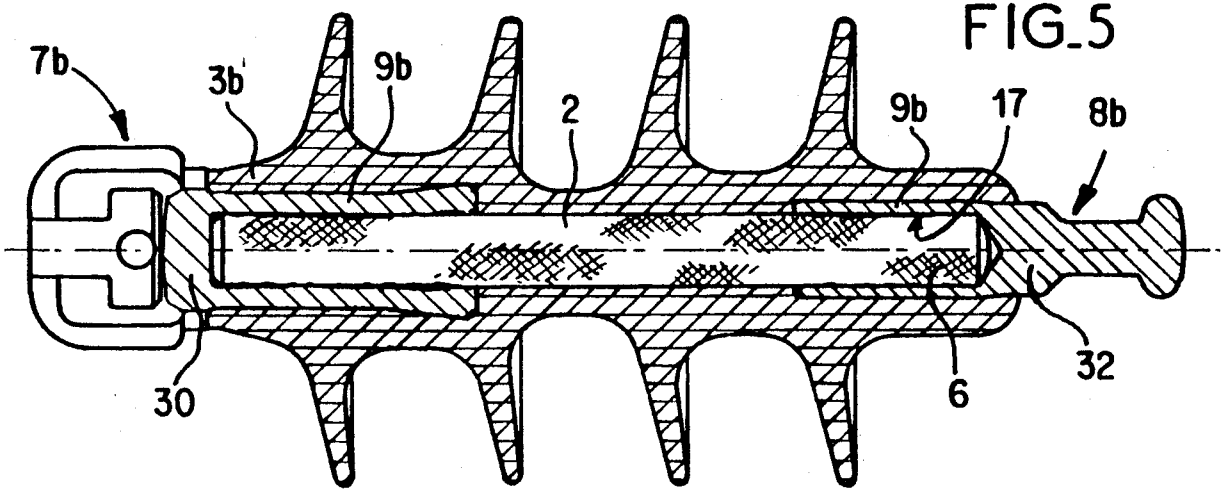
FIG. 5 is a side view in cross section showing another embodiment of an insulator.

In the embodiment shown in FIG. 5, mounting elements 7*b* and 8*b* of the terminals are in the form of elements that are respectively female and male, employed in a connection of the type usually referred to as ball and socket. Skirt 3*b* covers sleeves 9*b* completely so that its ends coincide with larger areas 30 and 32 of terminals 7*b* and 8*b*.

As in the previous embodiment, this particular arrangement of the skirt shifts the contact areas of a possible power arc connecting the two ends of the insulator, to parts 30 and 32, which are thicker and more resistant, allowing the insulator to resist short-circuit currents of higher intensity.

FIG. 5 also shows that because each sleeve is mounted on the rod by means of an operation involving compression and drawing with a die, in other words, by means that take up little space, the areas of connection between the sleeves and the rod can be in the immediate proximity of the area where the terminal is mounted. This advantage, combined with the possibility of molding the skirt all the way up to its mounting areas, makes it possible to create a composite insulator that has insulating characteristics equal to those of a traditional insulator and is also of the same length as these insulators. It is therefore possible to replace traditional insulators by composite insulators on electrical power lines.

What is claimed is:

1. A composite insulator, comprising:

a core;

a skirt integrally molded to said core, said skirt being made of an insulating material and provided with fins; and at least one mounting terminal being mounted at an end of said core;

wherein the core further comprises an axial rod made up of a web of fibers running parallel and lengthwise and bonded by a thermosetting resin, and a peripheral envelope composed of continuous fibers locked onto the web and bonded to it by the thermosetting resin, and the mounting terminal has a metal sleeve that is swaged onto the corresponding end of the rod to produce a connection that is a uniformly distributed radial locking of the sleeve onto the rod and has notches of the metal of the sleeve penetrating into gaps between the fibers in the envelope.

2. An Insulator according to claim 1, wherein the envelope is comprised of a braid.

3. An insulator according to claim 1, wherein the envelope is comprised of a weave.

4. An Insulator according to claim 1, wherein the sleeve of the mounting terminal comprises an external cylindrical support located longitudinally opposite its free end and having an outside diameter and shape resembling those of a internal profile of a die used to swage the sleeve onto the rod.

5. An insulator according to claim 4, wherein the mounting terminal further comprises a wide area having a thicker cross section between the sleeve providing the connection with the rod and its mounting means and a fastening to a support and the molded shirt extends over the sleeve and is attached to the sleeve near said wide area.

* * * * *